US008794916B2

(12) United States Patent
Ura

(10) Patent No.: US 8,794,916 B2
(45) Date of Patent: Aug. 5, 2014

(54) SHROUD SUPPORTING STRUCTURE FOR GAS TURBINE ENGINE

(75) Inventor: Yoshiyuki Ura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 886 days.

(21) Appl. No.: 12/962,164

(22) Filed: Dec. 7, 2010

(65) Prior Publication Data

US 2012/0137705 A1 Jun. 7, 2012

(51) Int. Cl.
*F01D 25/24* (2006.01)
*F01D 11/08* (2006.01)

(52) U.S. Cl.
CPC ..... *F01D 11/08* (2013.01); *F05D 2240/11* (2013.01); *F05D 2230/60* (2013.01)
USPC ..... 415/213.1

(58) Field of Classification Search
USPC ..... 415/173.1, 213.1, 214.1
See application file for complete search history.

(56) References Cited

U.S. PATENT DOCUMENTS

| | | | | |
|---|---|---|---|---|
| 3,339,832 A | | 9/1967 | Duecker | |
| 5,219,190 A | * | 6/1993 | Grammel, Jr. | 285/305 |
| 5,259,725 A | * | 11/1993 | Hemmelgarn et al. | 415/112 |

FOREIGN PATENT DOCUMENTS

| | | |
|---|---|---|
| JP | 46-23528 | 7/1971 |
| JP | 53-125558 | 11/1978 |
| JP | 56-124712 | 9/1981 |
| JP | 2001-303907 | 10/2001 |

OTHER PUBLICATIONS

Translation of JP 2001-303907.*

* cited by examiner

*Primary Examiner* — Ned Landrum
*Assistant Examiner* — Ryan Ellis
(74) *Attorney, Agent, or Firm* — Rankin, Hill & Clark LLP

(57) ABSTRACT

An annular shroud surrounding tip ends of turbine blades is fitted on an inner peripheral surface of an open end of a turbine case. In order to prevent the shroud from being dropped off in an axial direction by a retaining part provided on a retaining ring fitted on an outer peripheral surface of the open end of the turbine case, an annular groove formed in the outer peripheral surface of the turbine case and an annular groove formed in an inner peripheral surface of the retaining ring are opposed to each other, and a connection wire is inserted so as to straddle the two annular grooves, thereby connecting the retaining ring to the turbine case. Accordingly, it is possible to easily perform attachment/detachment of the retaining ring with respect to the turbine case only by inserting the connection wire into or pulling it out from the two annular grooves, thereby facilitating maintenance of the shroud and the turbine blades. Therefore, this can improve ease of attachment/detachment of the retaining ring retaining the shroud of a gas turbine engine to the turbine case.

4 Claims, 7 Drawing Sheets

SHROUD SUPPORTING STRUCTURE FOR GAS TURBINE ENGINE

BACKGROUND OF THE INVENTION

1. Field of the Invention

The present invention relates to a shroud supporting structure for a gas turbine engine, in which: an annular shroud surrounding tip ends of a plurality of turbine blades which are attached to a turbine disk in a radial arrangement is fitted on an inner peripheral surface of an open end of a turbine case; and a retaining ring fitted on an outer peripheral surface of the open end of the turbine case has a retaining part provided thereon to prevent the shroud from being dropped off in an axial direction.

2. Description of the Related Art

Such a shroud supporting structure for a gas turbine engine is known from Japanese Patent Application Laid-open No. 2001-303907. This invention has a configuration in which the shroud is divided into eight parts in the circumferential direction and is fitted on the inner peripheral surface of the turbine case, and in this state, the retaining ring fitted on the outer periphery of the turbine case is connected to the turbine case with eight rivets; and thereby the retaining part of the retaining ring is placed in engagement with the front end of the shroud, so that the shroud is prevented from dropping off from the turbine case.

Meanwhile, the above conventional configuration has the following problem: since the retaining ring is connected to the turbine case with the rivets, when the retaining ring is to be attached/detached at the time of assembling or doing maintenance on the gas turbine engine, the work to hammer or cut the rivets is necessary, thereby requiring a lot of time and labor for this work.

SUMMARY OF THE INVENTION

The present invention has been made in view of the foregoing situation, and an object thereof is to enhance attachment/detachment capability of a retaining ring retaining a shroud for a gas turbine engine to a turbine case.

In order to achieve the object, according to the present invention, there is provided a shroud supporting structure for a gas turbine engine, in which: an annular shroud surrounding tip ends of a plurality of turbine blades which are attached to a turbine disk in a radial arrangement is fitted on an inner peripheral surface of an open end of a turbine case; and a retaining ring fitted on an outer peripheral surface of the open end of the turbine case has a retaining part provided thereon to prevent the shroud from being dropped off in an axial direction, characterized in that an annular groove formed in the outer peripheral surface of the turbine case and an annular groove formed in an inner peripheral surface of the retaining ring are opposed to each other, and a connection wire is inserted so as to straddle both of the annular grooves, thereby connecting the retaining ring to the turbine case.

According to the above configuration, the annular shroud which surrounds the tip ends of the turbine blades is fitted on the inner peripheral surface of the open end of the turbine case; and, in order to prevent the shroud from being dropped off in the axial direction by the retaining part provided on the retaining ring fitted on the outer peripheral surface of the open end of the turbine case, the annular groove formed in the outer peripheral surface of the turbine case and the annular groove formed in the inner peripheral surface of the retaining ring are opposed to each other, and the connection wire is inserted so as to straddle the two annular grooves, thereby connecting the retaining ring to the turbine case. Accordingly, it is possible to easily perform attachment/detachment of the retaining ring with respect to the turbine case only by inserting the connection wire into or pulling it out from the two annular grooves, thereby improving ease of attachment/detachment of the shroud and the turbine blades.

The above description, other objects, characteristics and advantages of the present invention will be clear from detailed descriptions which will be provided for the preferred embodiment referring to the attached drawings.

BRIEF DESCRIPTION OF THE DRAWINGS

Attached drawings show an embodiment of the present invention.

DESCRIPTION OF THE PREFERRED EMBODIMENT

An embodiment of the present invention will be described below based on FIG. 1 to FIG. 7.

Figure 1:
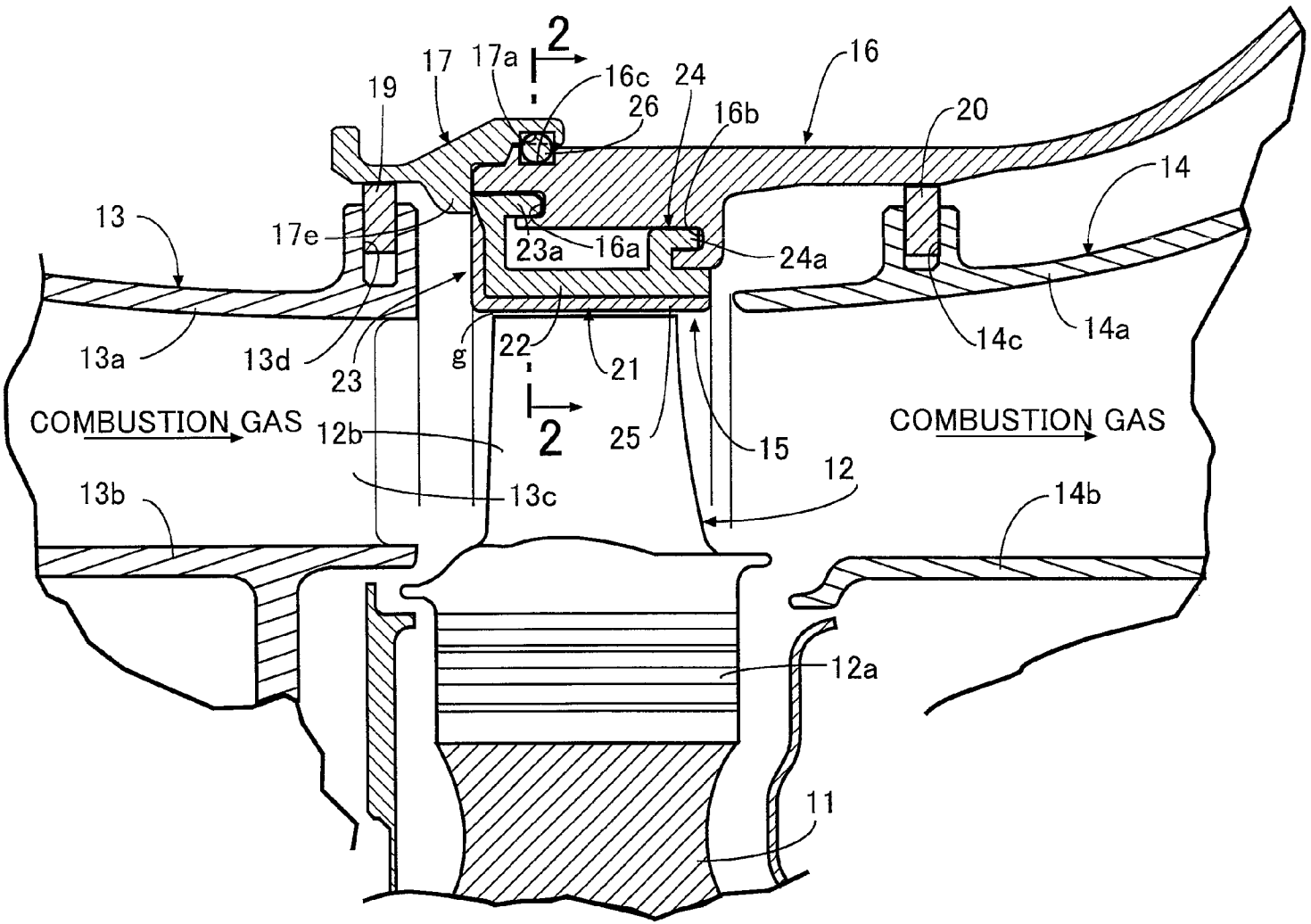
FIG. 1 is a longitudinal cross-sectional view of a part of a gas turbine engine showing a neighboring portion of a turbine blade.

As shown in FIG. 1, an axial-flow type gas turbine engine includes a turbine disk 11 fixed to a turbine shaft, which is not illustrated, and a plurality of turbine blades 12 are supported in a radial arrangement on an outer periphery of the turbine disk 11 via an attachment part 12*a*. A nozzle 13 in which combustion gas from a combustor, which is not illustrated, flows is disposed on an upstream side (left side in the drawing) of the turbine blade 12. The nozzle 13 is formed of an annular shape having an outer peripheral wall 13*a* and an inner peripheral wall 13*b*, and a downstream end of the nozzle 13 faces a front surface of a main part 12*b* of the turbine blade 12. The outer peripheral wall 13*a* and the inner peripheral wall 13*b* of the nozzle 13 are connected by a plurality of stator vanes 13*c* which are disposed in a radial arrangement. An exhaust passage 14 disposed on a downstream side (right side in the drawing) of the turbine blade 12 is formed of an annular shape having an outer peripheral wall 14*a* and an inner peripheral wall 14*b*, and an upstream end of the exhaust passage 14 faces a rear surface of the main part 12*b* of the turbine blade 12.

A shroud 15 which faces a tip end (outer end in a radial direction) of the turbine blade 12 with a slight gap (g) interposed therebetween is disposed so as to close a space interposed between the outer peripheral wall 13*a* of the nozzle 13 and the outer peripheral wall 14*a* of the exhaust passage 14. A tubular turbine case 16 covering an outer periphery of the exhaust passage 14 and extending toward the front (left side in the drawing) surrounds an outer periphery of the shroud 15, and an open end of the turbine case 16 and a front end of the shroud 15 are covered by an integrally formed annular retaining ring 17. A sealing member 19 is supported in an annular groove 13*d* provided in a projecting manner on the outer peripheral surface of the outer peripheral wall 13*a* of the nozzle 13 for sealing a space between an inner peripheral surface of a front part of the retaining ring 17 and the annular groove 13*d*, and a sealing member 20 is supported in an annular groove 14*c* provided in a projecting manner on the outer peripheral surface of the outer peripheral wall 14*a* of the exhaust passage 14 for sealing a space between an inner peripheral surface of the turbine case 16 and the annular groove 14*c*.

Next, referring to FIG. 2 to FIG. 7 together, a structure of the shroud 15 and a structure for supporting the shroud 15 to the turbine case 16 with the retaining ring 17 will be explained.

Figure 2:
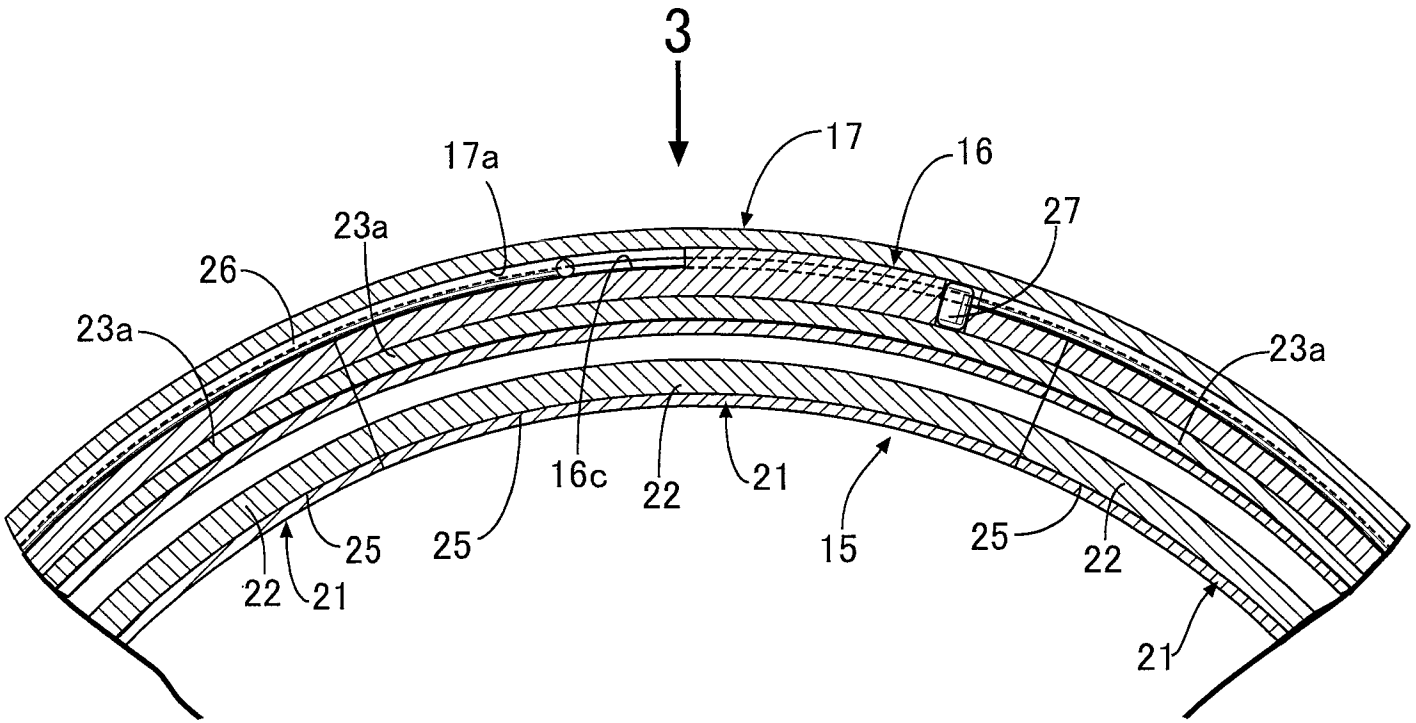
FIG. 2 is a sectional view taken along a line 2-2 in FIG. 1.

As is clear from FIG. 1 and FIG. 2, the shroud 15 disposed annularly with an axis of the gas turbine engine being a center is configured such that eight segments 21 of the same structure each having a center angle of 45° are connected in a circumferential direction. Here, adjacent segments 21 simply abut each other and have no special connecting structure, and the shroud 15 is retained annularly by the turbine case 16 being engaged with the retaining ring 17.

The segment 21 of the shroud 15 comprises a shroud main body 22 curved in a circular arc shape, a first flange 23 rising from a front end of the shroud main body 22 outward in the radial direction, and a second flange 24 rising from a rear end of the shroud main body 22 outward in the radial direction. A width in the radial direction of the first flange 23 is formed to be larger than a width in the radial direction of the second flange 24. A part of the segment 21 which is exposed to combustion gas, that is, a radially inner surface of the shroud main body 22, and a part of a front surface of the first flange 23 are covered by a liner 25 having a heat resistance.

On a radially outer end of the first flange 23 of each of the segments 21, a first engaging part 23*a* protruding rearward is formed over its entire length. On a radially outer end of the second flange 24 of the segment 21, a second engaging part 24*a* protruding rearward is formed over its entire length.

An annular first engaged part 16*a* opened toward the front and an annular second engaged part 16*b* formed at a position radially inward and rearward of the first engaged part 16*a* and opened toward the front are formed in the inner peripheral surface of the turbine case 16. The first engaging part 23*a* and the second engaging part 24*a* of each segment 21 of the shroud 15 are engaged, from the front, with the first engaged part 16*a* and the second engaged part 16*b* of the turbine case 16, respectively.

The retaining ring 17 fitted, from the front, on an outer peripheral surface of a front end of the turbine case 16 has an annular groove 17*a* of a rectangular section formed in the inner peripheral surface of a rear end thereof. An annular groove 16*c* of a rectangular section facing this annular groove 17*a* is formed in the outer peripheral surface of the front end of the turbine case 16. And both of the annular grooves 17*a*, 16*c* form a square section in cooperation with each other and are engaged with a connection wire 26 having flexibility and a circular section, so that the retaining ring 17 is fixed so as not to drop off from the turbine case 16 to the front side. In a state in which the retaining ring 17 is connected to the turbine case 16, a engaging part 17*e* provided, in a protruding manner, radially inward on the inner peripheral surface of the retaining ring 17 is engaged with a front surface of the first flange 23 of the shroud 15, so that the shroud 15 is retained so as not to drop off from the turbine case 16 to the front side.

Figure 3:
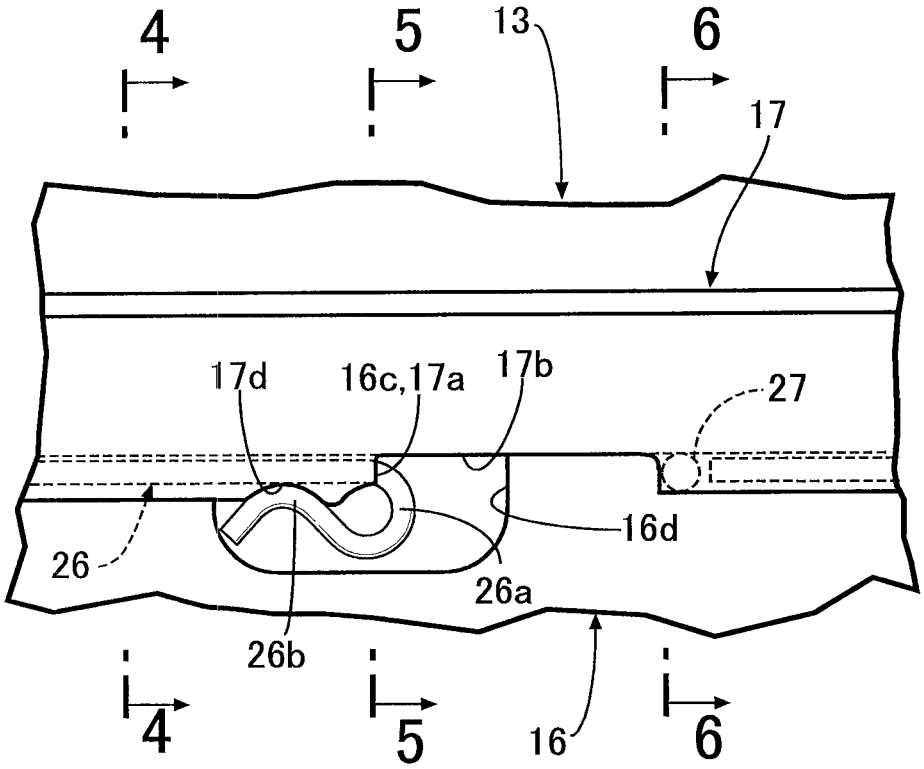
FIG. 3 is a view seen from a direction of an arrow 3 in FIG. 2.
Figure 5:
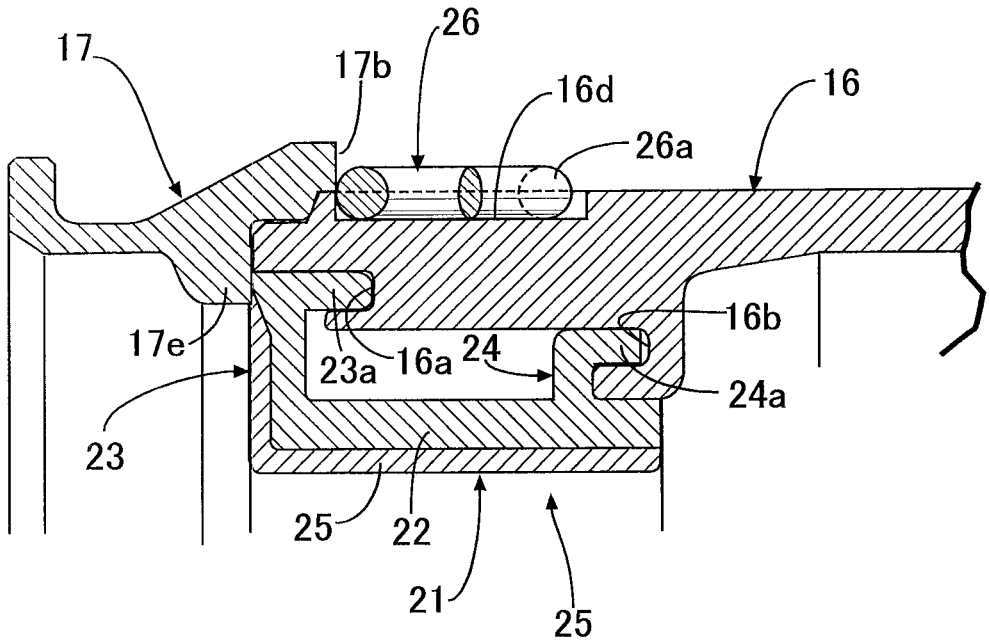
FIG. 5 is a sectional view taken along a line 5-5 in FIG. 3.

As is clear from FIG. 3 and FIG. 5, a recess 16*d* depressed radially inward is formed in a part of the turbine case 16 which faces a cutout 17*b* formed in a rear edge of the retaining ring 17 and extending in the peripheral direction. The annular groove 16*c* of the turbine case 16 and the annular groove 17*a* of the retaining ring 17 are opened in an end of the cutout 17*b* of the retaining ring 17.

Figure 6:
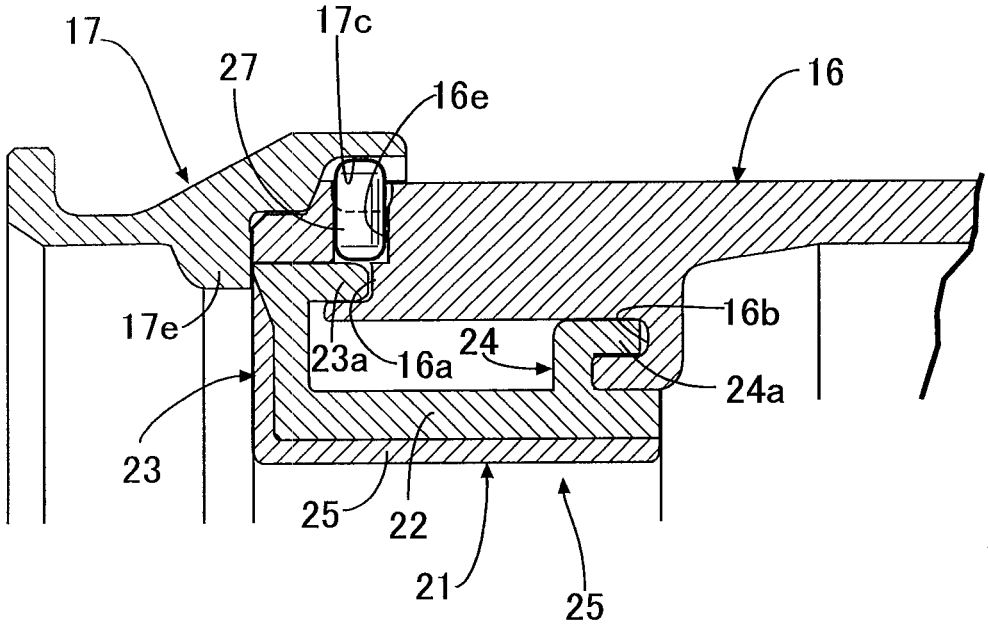
FIG. 6 is a sectional view taken along a line 6-6 in FIG. 3.

As is clear from FIG. 3 and FIG. 6, a rotation-preventing pin 27 is engaged with a pin hole 17*c* formed in the retaining ring 17 in the vicinity of the other end of the cutout 17*b* and a pin hole 16*e* formed in the turbine case 16, so that the retaining ring 17 is restrained against rotation relative to the turbine case 16.

Figure 7:
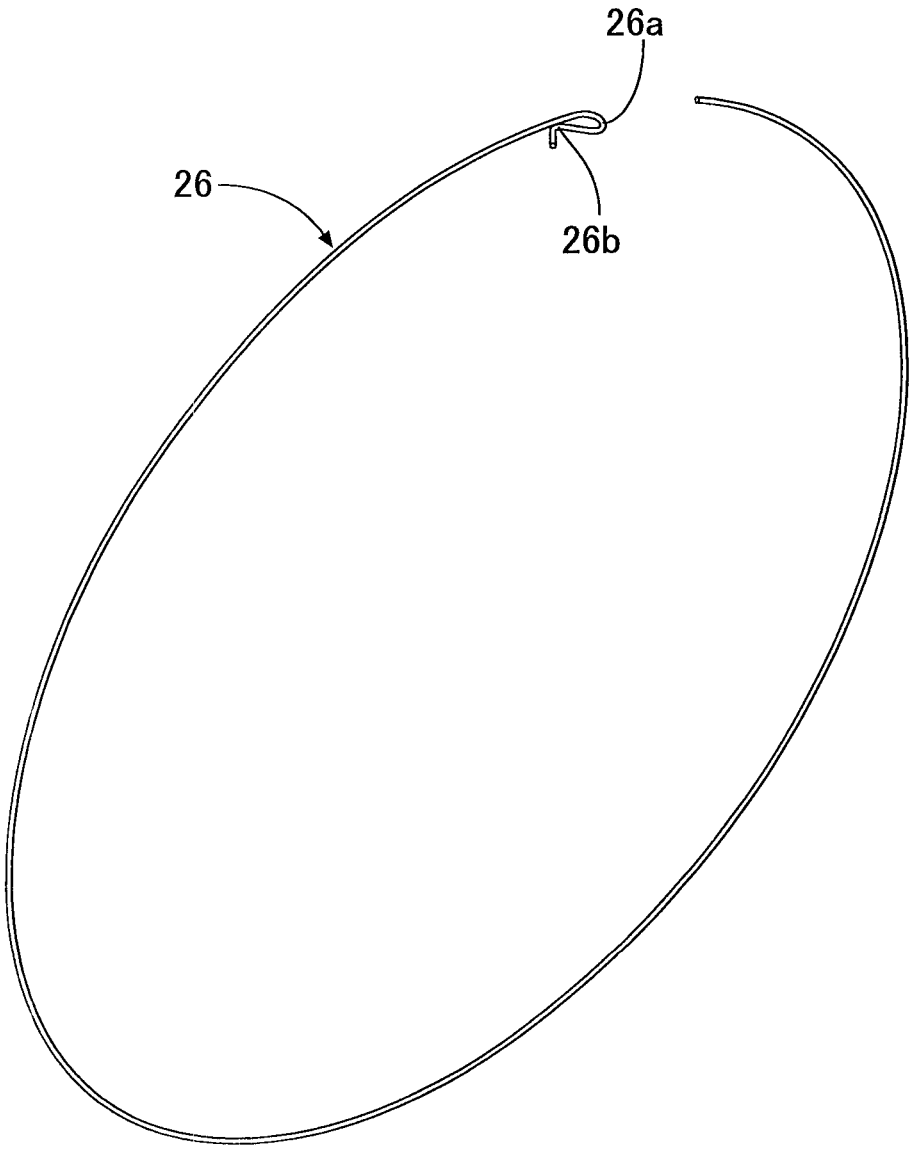
FIG. 7 is a perspective view of a connection wire.

As is clear from FIG. 3 and FIG. 7, the connection wire 26 is formed by curving a wire having an elasticity to form an annular shape over substantially 360°, and includes a small-loop-shaped grip part 26*a* at one end thereof and a retaining part 26*b* curved so as to continue with the grip part 26*a*. And the retaining ring 17 includes a recess 17*d* which is formed in an end edge thereof adjacent to the cutout 17*b*, with which recess the retaining part 26*b* of the connection wire 26 can be engaged.

Next, operations of the embodiment of the present invention having the above configuration will be explained.

When the shroud 15 and the retaining ring 17 are assembled to the turbine case 16, the eight divided segments 21 of the shroud 15 are moved from the front to the rear in FIG. 1 (left side to right side in the drawing); and the first engaging part 23*a* formed on the first flange 23 of each segment 21 is engaged with the first engaged part 16*a* of the turbine case 16 and, concurrently, the second engaging part 24*a* formed on the second flange 24 of each segment 21 is engaged with the second engaged part 16*b* of the turbine case 16. Accordingly, the eight segments 21 are integrally connected together, thereby forming the annular shroud 15.

Next, in a state in which the retaining ring 17 is fitted on the open end of the turbine case 16, the retaining ring 17 is positioned in the rotational direction so as to place the pin hole 17*c* of the retaining ring 17 in alignment with the pin hole 16*e* of the turbine case 16, and the rotation-preventing pin 27 is inserted into both of the pin holes 17*c*, 16*e*. Subsequently, while elastically deforming the annular connection wire 26 into an elongated state, a tip end of the connection wire 26 on a side opposite from the grip part 26*a* is inserted from the cutout 17*b* of the retaining ring 17 into both of the annular grooves 16*c*, 17*a* opened in the recess 16*d* of the turbine case 16. As a result, the connection wire 26 is fitted, over substantially 360°, on both of the annular grooves 16*c*, 17*a*, and, finally, the retaining part 26*b* provided continuously with the grip part 26*a* is engaged with the recess 17*d* of the retaining ring 17, so that the grip part 26*a* is housed in the recess 16*d* of the turbine case 16 (see FIG. 3).

Figure 4:
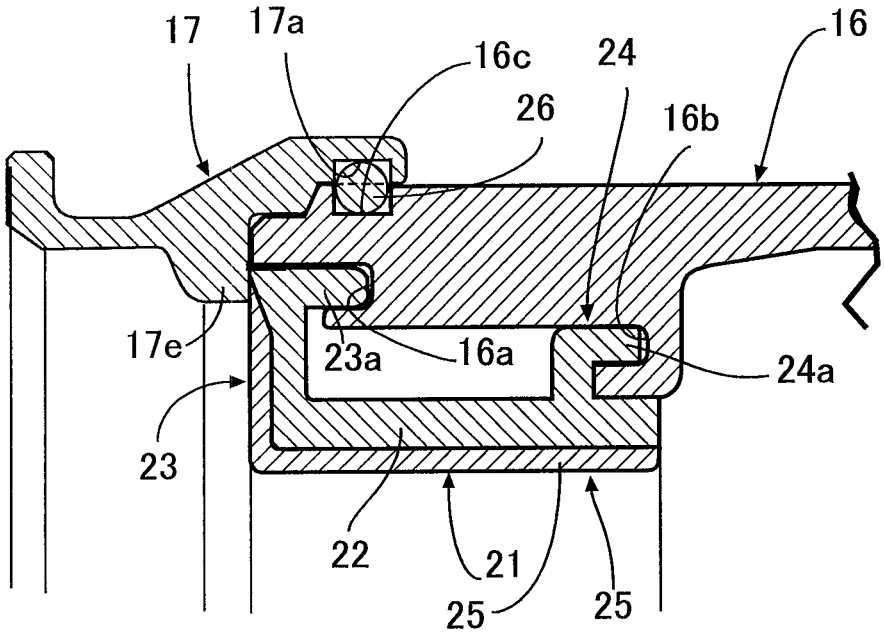
FIG. 4 is a sectional view taken along a line 4-4 in FIG. 3.

In this state, as shown in FIG. 4, the connection wire 26 is engaged so as to straddle both of the annular groove 17*a* of the retaining ring 17 and the annular groove 16*c* of the turbine case 16. Accordingly, the retaining ring 17 is connected to the turbine case 16, and the shroud 15 is prevented from dropping off form the inside of the turbine case 16 to the front side by the engaging part 17*e* of the retaining ring 17.

When the retaining ring 17 is to be separated from the turbine case 16, only the following work is required: the grip 26*a* of the connection wire 26 within the recess 16*d* of the turbine case 16 is gripped and pulled; and the entire connection wire 26 is pulled out from the annular groove 17*a* of the retaining ring 17 and the annular groove 16*c* of the turbine case 16. And, when the retaining ring 17 is separated from the turbine case 16, the shroud 15 can be freely attached to or detached from the open end of the turbine case 16, thereby improving the assemblability and ease of maintenance of the shroud 15. Further, since the shroud 15 can be fixed to the turbine case 16 only by the retaining function of the retaining ring 17, any special fixing member is not required, thereby reducing number of parts and cost.

One embodiment of the present invention is explained above, but the present invention may be modified in a variety of ways as long as the modifications do not depart from the gist of the present invention.

For example, in the embodiment, the shroud 15 is divided into eight segments 21, but the divided number is arbitrary.

Further, in the embodiment, when the eight segments 21 of the shroud 15 is assembled to the turbine case 16, the first and second engaging parts 23*a*, 24*a* of the segments 21 are engaged with the first and second engaged parts 16*a*, 16*b* of the turbine case 16, but it is possible to employ other arbitrary assembling structure.

The invention claimed is:

1. A shroud supporting structure for a gas turbine engine, in which:

an annular shroud surrounding tip ends of a plurality of turbine blades which are attached to a turbine disk in a radial arrangement is fitted on an inner peripheral surface of an open end of a turbine case; and a retaining ring fitted on an outer peripheral surface of the open end of the turbine case has a retaining part provided thereon to prevent the shroud from being dropped off in an axial direction, wherein an annular groove formed in the outer peripheral surface of the turbine case and an annular groove formed in an inner peripheral surface of the retaining ring are opposed to each other, and a connection wire is inserted so as to straddle both of the annular grooves, thereby connecting the retaining ring to the turbine case, a turbine case recess depressed radially inward is formed in the outer peripheral surface of the turbine case, a retaining ring recess is formed in the retaining ring, and a cutout is formed in the retaining ring at a position adjacent to the retaining ring recess, the turbine case recess is opposed to the retaining ring recess and the cutout, and the turbine case recess, the retaining ring recess, and the cutout communicate with the annular grooves, and the connection wire is inserted into the annular grooves through the cutout and the opposed turbine case recess and retaining ring recess.

2. The shroud supporting structure according to claim 1, wherein the connection wire includes a grip part having a connection wire retaining part, and the connection wire retaining part engages a portion of the retaining ring that defines the retaining ring recess.

3. The shroud supporting structure according to claim 2, wherein, when engaged with the portion of the retaining ring that defines the retaining ring recess, at least a portion of the grip part projects radially inward so as to be at least partially held within the turbine case recess.

4. The shroud supporting structure according to claim 1, wherein a pin hole is formed in the retaining ring and a pin hole is formed in the turbine case so as to be opposed to the pin hole in the retaining ring, and a pin is engaged with both of the pin holes.

* * * * *